US005313684A

United States Patent [19]

Fitjer

[11] Patent Number: 5,313,684

[45] Date of Patent: May 24, 1994

[54] DENTAL BRUSH HOLDING DEVICE

[75] Inventor: Holger Fitjer, Ansbach, Fed. Rep. of Germany

[73] Assignee: Georg Karl Geka-Brush GmbH, Bechhofen-Waizendorf, Fed. Rep. of Germany

[21] Appl. No.: 936,441

[22] Filed: Aug. 28, 1992

[30] Foreign Application Priority Data

Aug. 30, 1991 [DE] Fed. Rep. of Germany ..... 9110747

[51] Int. Cl.[5] ..... A46B 9/04; A46B 3/00

[52] U.S. Cl. ..... 15/167.1; 15/176.5; 132/321

[58] Field of Search ..... 15/167.1, 176.4, 176.5, 15/176.6, 206; 132/308, 309, 313, 321

[56] References Cited

U.S. PATENT DOCUMENTS

| | | | |
|---|---|---|---|
| 1,063,523 | 6/1913 | Farrar | 15/167.1 |
| 3,559,226 | 2/1971 | Burns | 15/167.1 |
| 4,222,143 | 9/1980 | Tarrson et al. . | |
| 4,319,377 | 3/1982 | Tarrson et al. . | |
| 4,387,479 | 6/1983 | Kigyos | 15/206 |
| 4,572,223 | 2/1986 | Rosenfeld | 132/309 |
| 4,710,996 | 12/1987 | Tarrson | 15/206 |
| 4,751,761 | 6/1988 | Breitschmid | 15/176.5 |
| 4,780,923 | 11/1988 | Schultheiss | 15/206 |
| 4,805,252 | 2/1989 | Tarrson | 15/176.1 |
| 5,029,358 | 7/1991 | Zimmerman | 15/206 |

*Primary Examiner*—Philip R. Coe
*Assistant Examiner*—Randall E. Chin
*Attorney, Agent, or Firm*—Browdy and Neimark

[57] ABSTRACT

In a holding device comprising a handle and a holding section for exchangeably arresting a dental cleaning brush with a wire stem, the holding section having a bore extending about perpendicularly to the longitudinal axis of the holder and approximately corresponding to the diameter of the wire stem of the brush and into which the stem of the brush can be inserted, a longitudinally displaceable locking member being provided to arrest the stem safeguarded against rotation by a longitudinal slot after its being bent by 90°, it is provided in accordance with the invention that the bore opens into a longitudinal recess at the free end of the holding section, and that from the free end the locking member displaceably engages with the longitudinal recess, the stem of the brush being bent over by the displacement of the locking member inwards in the axial direction and being arrested between a longitudinal slot of the locking member and the internal wall of the longitudinal recess on the one hand and in the bore on the other hand.

8 Claims, 2 Drawing Sheets

DENTAL BRUSH HOLDING DEVICE

FIELD OF THE INVENTION

Figure 1:
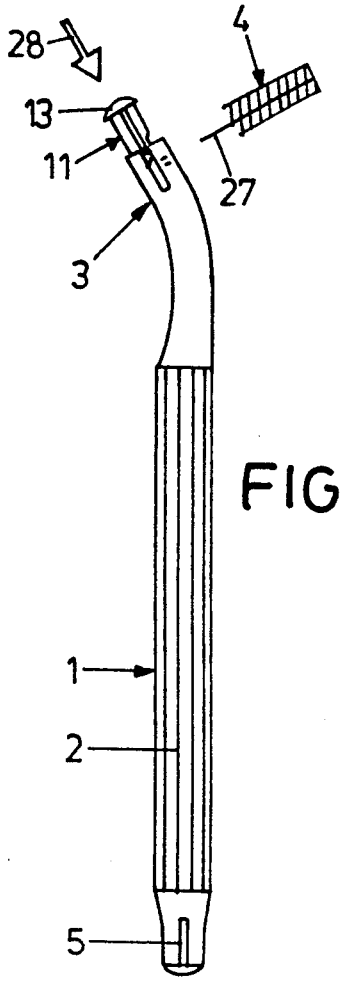

The invention relates to a holding device comprising a handle and a holding section for exchangeably arresting a dental cleaning brush with a wire stem, the holding section having a bore extending about perpendicularly to the longitudinal axis of the holder and approximately corresponding to the diameter of the wire stem of the brush and into which the stem of the brush can be inserted, a longitudinally displaceable locking member being provided to arrest the stem safeguarded against rotation by a longitudinal slot after its being bent by 90°.

BACKGROUND OF THE INVENTION

A holding device of the generic type is known for instance from U.S. Pat. No. 4,222,143 and U.S. Pat. No. 4,319,377.

The prior art device has the bore provided at one end of the holder such that when inserted the stem of the brush exits at the other end of the bore, which passes throughout the handle member. To be arrested the stem must be bent by 90° manually, for instance with the help of the thumb, so that it rests in a longitudinal groove of a thumb trough, a locking member in the form of a longitudinally displaceable sleeve surrounding the holder being pushed over the thus positioned stem end for fastening.

This kind of arresting of the brush has the disadvantage that to mount the brush it takes comparatively much skill and attention to bend the stem such that the locking sleeve can then be pushed over. When the brush is removed for instance to be exchanged for a new one, the stem of the brush must be dug out of the recess with the help of the finger nail and bent upwards, so that it can then be pulled out through the bore.

SUMMARY OF THE INVENTION

It is accordingly an object of the invention to further develop a holding device of the above generic type such that a simple and hygienic mounting and dismounting of the dental brush is ensured.

In keeping with an aspect of the invention this object is accomplished in that the bore opens into a longitudinal recess at the free end of the holder and in that from the free end the locking member displaceably engages with the longitudinal recess, the stem of the brush being bent over by the displacement of the locking member inwards in the axial direction and being arrested between a longitudinal slot of the locking member and the internal wall of the longitudinal recess on the one hand and in the bore on the other hand.

As a result of this structuring no special skill is needed to bend over and position the end of the stem of the dental brush, because once the stem is inserted in the bore the locking member only has to be pressed upon from the free end of the longitudinal bore, the bending of the stem and the locking into place taking place in a single sequence of operations.

For removal of the brush the locking member only has to be pushed back; the brush can then be removed with its stem still bent because the bore only has a short length. Correspondingly, any additional manipulation to bend up and straighten the stem is suppressed.

In keeping with a further aspect of the invention it is provided for the front end of the locking member seen in the direction of insertion to have a wedge portion biased in relation to the longitudinal axis or the transverse axis of the holder for the purpose of initially bending the stem of the brush.

Consequently, if the locking member is displaced after insertion of the brush into the bore, the end of the stem is first bent by about 40° through this wedge portion.

Advantageously, this wedge portion is followed by a retaining portion for instance of slightly staggered arrangement relative to it in the longitudinal direction and extending substantially perpendicularly to the longitudinal axis and which ensures upon insertion that the end of the stem is vertically bent and arrested.

It is of advantage for the locking member to have an enlarged outer head portion bearing against the front of the longitudinal recess. Consequently this head portion serves on the one hand as an abutment and on the other hand as a handle or actuator for displacement of the locking member.

Advantageously, the locking member is longitudinally guided against rotation by way of guide shoulders engaging with the jacket of the longitudinal recess. In combination with the longitudinal groove on the locking member this ensures that the stem and thus the entire dental brush is positioned and locked into a defined place.

At the front end of the locking member seen in the direction of insertion, which is the inward end referred to the holder, stop projections are provided to prevent the locking member from falling out when it is released. While the head portion forms an abutment for the insertion, these stops prevent the locking member from falling out.

Advantageously, the embodiment is such that the stop projections are formed on the guide shoulders, the guide shoulder being arranged in guide slots open at their ends in the vicinity of the longitudinal bore of the holder and the guide slots having at their ends stops which cooperate with the stops on the guide shoulders. As a result of the slot structure it is possible, for the purpose of mounting, to insert the locking member by slight elastic widening in the vicinity of the longitudinal bore and by overcoming the stops per se provided, once inserted it being displaceable only to a defined extent in the two longitudinal directions.

It is of special advantage if provision is made for the holder to have an inside closable cavity accommodating at least one spare brush. The closing of the cavity can be made by a construction similar to that of the locking member, so that uniform handling is ensured for the user added by attractive symmetrical design.

Figure 2:
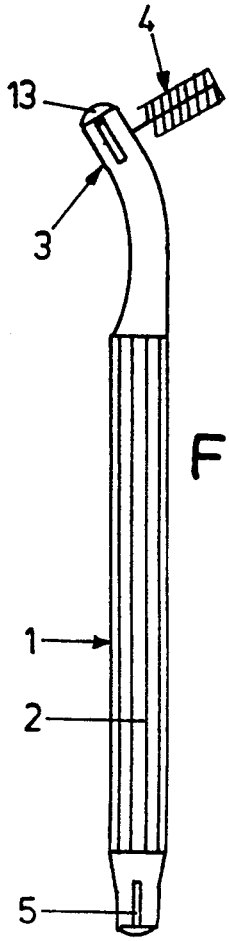
Figure 3:
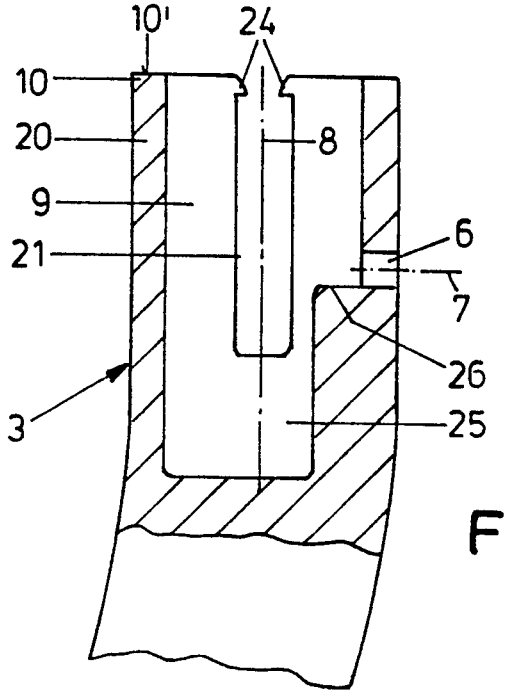
Figure 7:
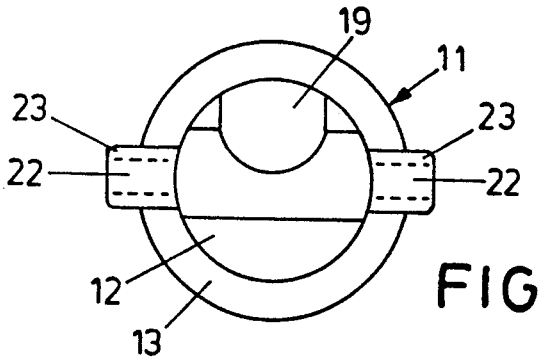
Figure 4:
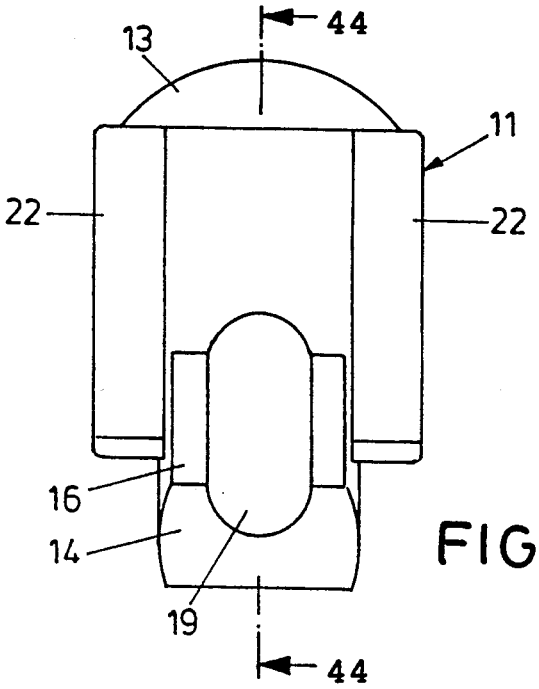
Figure 5:
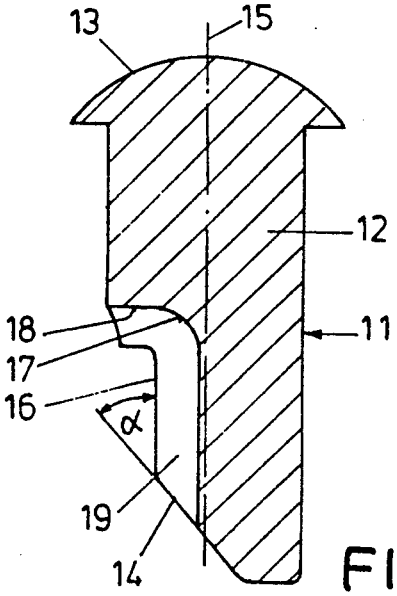
Figure 6:
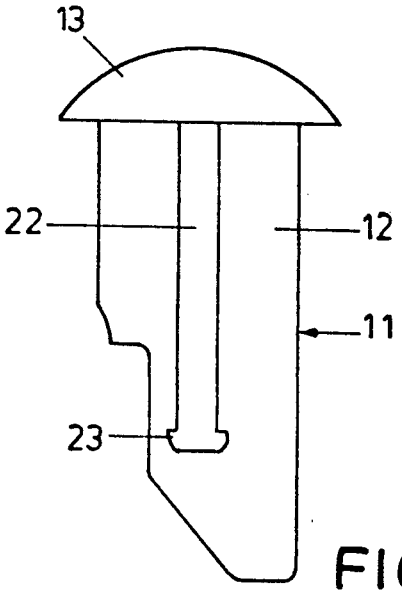

Further details of the invention will become apparent from the ensuing description of a preferred embodiment taken in conjunction with the drawing, in which FIG. 1 is a lateral view of a holding device according to the invention, a dental brush to be arrested being outlined, FIG. 2 is an illustration corresponding to FIG. 1 with the dental brush arrested, FIG. 3 is a longitudinal section through the holding section of the holding device according to FIGS. 1 and 2, FIG. 4 is a plan view of a locking member used according to the invention, FIG. 5 is a longitudinal section along the line 44—44 in FIG. 4, FIG. 6 is a lateral view turned by 90° in relation to FIG. 4, and FIG. 7 is a front view of the locking member.

A holding device illustrated in the drawing comprises a handle 1 with a corrugated cylindrical surface 2 and a holding section 3 slightly bent off the handle 1 for arresting a dental brush 4.

The handle is hollow inside to accommodate spare brushes. The internal cavity is closed by a plugged-on closing member 5.

The holding section 3 shown on a larger scale and in section in FIG. 3 comprises a bore 6, of which the longitudinal axis 7 extends perpendicularly to the longitudinal axis 8 of the holding section 3. This bore 6 opens into a longitudinal recess 9, which extends from the free end 10 of the holding section in the axial direction in the way of a blind bore.

A locking member 11, more closely illustrated in FIGS. 4 to 7, is axially displaceably supported in the longitudinal recess 9.

The locking member 11 has a cylindrical basic body 12, of which the diameter corresponds to that of the longitudinal recess 9. The outer end has a lens-shaped head 13 radially projecting over the basic body 12 and consequently bearing against the front face 10' of the longitudinal recess 9 upon insertion. In the vicinity of the inner end, the locking member 11 has a wedge portion 14 biased by an angle $\alpha$ of for instance 40° in relation to the longitudinal axis 15 of the locking member 11. The wedge portion 14 passes into a segmental portion 16 extending in parallel to the longitudinal axis 15, which, after extending axially for a certain length, passes via a 90° bending 17 into a portion 18, which extends at right angles to the longitudinal axis 15.

A longitudinal slot 19 extends in the longitudinal direction in the segmental portion 16 and the portion 18 bent by 90° in relation to the latter, as clearly seen in FIG. 5 in particular.

Two guide slots 21 facing each other and extending in the longitudinal direction are formed in the jacket 20 of the longitudinal recess 9; they are in engagement with guide shoulders 22 of the locking member 11 ensuring a longitudinal guidance safeguarded against rotation.

Stops 23 are formed at the ends of the guide shoulders 22 and cooperate with corresponding stops 24 at the free end of the guide slots 21, so that on the one hand the locking member 11 can be inserted, for the purpose of mounting, by elastically widening the guide slots 21, but once in, service is captivated from falling out.

The portions with the longitudinal slot 19, of the locking member 11 positively engage with a portion 25 of the holding section of the handle 1 (cf. FIG. 3) passing via a shoulder 26 into the area of undiminished diameter of the longitudinal recess 9. The shoulder 26 extends in radial continuation of the bore 6 and, with the axis 7 of the bore 6, forms a right angle such that after extending radially for a certain length it turns off by 90° and extends in parallel to the longitudinal axis 8 of the longitudinal recess 9 and of the holding section, respectively.

The arresting of a dental brush 4 with a still straight and undeformed wire stem 27 is made such that this wire stem 27 is entered into the bore 6 until the end of the stem 27 abuts on the opposite jacket 20 of the longitudinal recess 9. The locking member 11 is in a drawn-out position as shown in FIG. 1. If the locking member 11 is acted upon by the thumb in the direction of the arrow 28 in FIG. 1, the wedge portion 14 first bears against the stem 27 correspondingly bending it by 40°, whereby it gets into the vicinity of the central longitudinal slot 19. Upon further insertion the stem 27 is bent parallel to the longitudinal axis 8 of the longitudinal recess 9 and comes to rest in the longitudinal slot 19 in the vicinity of the portion 18 until the locking member is pushed in totally and the radial portion 18 with the corresponding slot portion surrounds the part of the stem which exits through the bore 6. The stem 27 is arrested absolutely free of play in the radial direction as well as in the longitudinal direction, this arresting taking place practically automatically as a result of the structure of the longitudinal bore of the locking member, i.e. there is no need at all for skill or attention of the operating person.

For release or exchange of the dental brush 4 the locking member 11 is again drawn out by means of the head 13 and the dental brush 4 can then be removed without any problem due to the short radial length over which the bore extends without any prior straightening of the stem being necessary.

What is claimed is:

1. A holding device comprising a handle and a holding section for exchangeably arresting a dental cleaning brush with a wire stem, the holding section having a longitudinal recess having a free end and defining an internal wall and a longitudinal axis and a bore (6) extending substantially perpendicular to said longitudinal axis of the holding section, said bore approximately corresponding to the diameter of the wire stem of the brush and into which the stem of the brush can be inserted, a displaceable locking member having a longitudinal slot being provided to arrest the stem within the longitudinal slot after said wire stem is bent by 90°, wherein the bore (6) communicates with the longitudinal recess (9) at said free end of the holding section (3), and wherein when a free end of the locking member (11) is inserted into the longitudinal recess (9), the stem (27) of the brush (4) is bent over by the insertion of the locking member (11) into the longitudinal recess in the axial direction and is arrested both between the longitudinal slot (19) of the locking member (11) and said internal wall of the longitudinal recess (9) and in the bore (6), wherein the free end of the locking member (11) seen in the direction of insertion (arrow 28) into the longitudinal recess has a wedge portion (14) biased in relation to the longitudinal axis (8) for the purpose of initially bending the stem (27) of the brush (4).

2. A holding device according to claim 1, wherein the wedge portion (14) is spaced from a holding portion (18) at a distance along a longitudinal axis of the locking member wherein said holding portion extends substantially perpendicular to said longitudinal axis of the locking member.

3. A holding device according to claim 1, wherein the locking member (11) has an enlarged outer head (13), which comes to bear against a front face (10') of the longitudinal recess (9).

4. A holding device according to claim 1, wherein the locking member (11) has guide shoulders (22) which longitudinally guide the locking member against rotation by engaging with a jacket (20) of the longitudinal recess (9).

5. A holding device according to claim 1, wherein the locking member has stops (23) thereon which prevent the locking member (11) from falling out of the longitudinal recess when the locking member is withdrawn from the longitudinal recess, the stops being located at the free end of the locking member.

6. A holding device according to claim 5, wherein the locking member has guide shoulders and said holding section has guide slots (21) and the stops (23) are formed on the guide shoulders (22), the guide shoulders (22) being arranged in the guide slots (21), the guide slots having open ends in the vicinity of the longitudinal recess (9) and the open ends having stops (24) which cooperate with the stops on the guide shoulders (22).

7. A holding device according to claim 1, wherein the handle (1) has a closable cavity accommodating at least one spare brush.

8. A holding device comprising a handle and a holding section for exchangeably arresting a dental cleaning brush with a wire stem, the holding section having a longitudinal recess having a free end and defining an internal wall and a longitudinal axis and a bore (6) extending substantially perpendicular to said longitudinal axis of the holding section, said bore approximately corresponding to the diameter of the wire stem of the brush and into which the stem of the brush can be inserted, a displaceable locking member having a longitudinal slot being provided to arrest the stem within the longitudinal slot after said wire stem is bent by 90°, wherein the bore (6) communicates with the longitudinal recess (9) at said free end of the holding section (3), and wherein when a free end of the locking member (11) is inserted into the longitudinal recess (9), the stem (27) of the brush (4) is bent over by the insertion of the locking member (11) into the longitudinal recess in the axial direction and is arrested both between the longitudinal slot (19) of the locking member (11) and said internal wall of the longitudinal recess (9) and in the bore (6), wherein the free end of the locking member (11) seen in the direction of insertion (arrow 28) into the longitudinal recess has a wedge portion (14) biased in relation to the longitudinal axis (8) for the purpose of initially bending the stem (27) of the brush (4), wherein the wedge portion (14) is biased in relation to a transverse axis of the holding section (3) for the purpose of initially bending the stem (27) of the brush (4).

* * * * *